US009340985B1

(12) United States Patent
Efros

(10) Patent No.: US 9,340,985 B1
(45) Date of Patent: May 17, 2016

(54) METHOD FOR MAKING FLOORING USING WASTE LUMBER

(71) Applicant: PARQUET BY DIAN, Gardena, CA (US)

(72) Inventor: Anatoli Efros, Los Angeles, CA (US)

(73) Assignee: Parquet By Dian, Gardena, CA (US)

( * ) Notice: Subject to any disclaimer, the term of this patent is extended or adjusted under 35 U.S.C. 154(b) by 0 days.

(21) Appl. No.: 14/875,311

(22) Filed: Oct. 5, 2015

(51) Int. Cl.
*E04F 15/04* (2006.01)
*B27M 3/04* (2006.01)
*E04F 15/022* (2006.01)

(52) U.S. Cl.
CPC ..... *E04F 15/048* (2013.01); *B27M 3/04* (2013.01); *E04F 15/022* (2013.01)

(58) Field of Classification Search
CPC ..... E04F 15/048; E04F 15/022; B27M 3/04
USPC ..... 52/390, 588.1
See application file for complete search history.

(56) References Cited

U.S. PATENT DOCUMENTS 906,654 A * 12/1908 Papin ..... B32B 27/00 427/403
3,579,941 A * 5/1971 Tibbals ..... E04F 15/166 52/384
5,058,349 A * 10/1991 Conrad ..... E04F 15/04 52/392
5,755,068 A * 5/1998 Ormiston ..... B32B 3/30 428/167
6,021,615 A * 2/2000 Brown ..... E04F 15/022 428/167
6,119,423 A * 9/2000 Costantino ..... B44C 5/043 52/313
7,877,956 B2 * 2/2011 Martensson ..... E04F 15/04 52/581
8,307,597 B2 * 11/2012 Tucker, Jr. ..... E04F 15/022 52/403.1
8,394,217 B2 * 3/2013 Pien ..... E04B 5/026 156/182
9,121,183 B1 * 9/2015 Marmon ..... E04F 15/02188
2003/0200713 A1 * 10/2003 McStay ..... B44C 1/28 52/311.2
2008/0295433 A1 * 12/2008 Eyal ..... E04F 15/02038 52/403.1
2010/0119857 A1 * 5/2010 Johnson ..... B27N 1/00 428/537.1

* cited by examiner

*Primary Examiner* — Brian Glessner
*Assistant Examiner* — Paola Agudelo
(74) *Attorney, Agent, or Firm* — Fulwider Patton LLP

(57) ABSTRACT

A method for creating a parquet flooring is disclosed where scrap slats of wood from a woodworking manufacturing operation are collected and cut into blocks of a uniform length. The blocks are then arranged into tiles having a staggered pattern. The parquet tiles are then interlocking together by rotating one of the tiles into a complimentary pattern to create a flooring.

2 Claims, 5 Drawing Sheets

METHOD FOR MAKING FLOORING USING WASTE LUMBER

BACKGROUND

Hardwood lumber (mostly, red oak, white oak and walnut) are used in the production of solid strip flooring (under 3" wide) and plank flooring (3" and wider), furniture components, wooden door and window productions and many more products by factories that use hardwood lumber. A majority of the wood that is used in this process is approximately one inch thick. The uses include:

Hardwood lumber (red oak, white oak, walnut, etc.) is used in production of: solid flooring in form of strip (typically 2-2¼" wide) and plank (3" and wider);

Engineered flooring is constructed with a top layer made from hardwood (about 3-6 mm thick) is glued to a bottom layer of plywood;

Furniture components;

Door, window and cabinets production;

Moulding production, as well as many more wood product applications.

The first step in the production of such hardwood products typically is a ripping of kiln-dried random wide boards lumber into a strip of a specified width. These kiln-dried hardwood boards are typically not uniform in width and include various imperfections on their edges such as vein, bark, cracks, splits and other defects. These imperfections need to be removed as a result of the ripping operation.

In the manufacture of these products, the unused portion of the lumber boards represents a significant percentage of the total amount of the wood (e.g., between ten percent thirty percent (10%-30%). The unused pieces are between three fourths to two inches wide and either stored at manufacturing facilities for various purposes, or alternatively, dumped as a waste or burned. Such unused hardwood lumber waste through the country amounts to many millions of board feet of wood, creating a huge environmental problem and an economical problem.

SUMMARY OF THE INVENTION

The present invention addresses the issues of ecological and economical waste in the production of various wood products by utilizing the scrap wood to construct a flooring made entirely from waste.

The present invention converts the unusable hardwood waste into narrow (about 0.90" wide and $7/16^{th}$" thick) straight edge (no tongue and groove) strips, which is cut to the desired length and then assembled in staggered tiles.

Additional advantages of such tiles are:

fast installations;

concrete floor, which this tile will be glued to, can be uneven due to the fact that narrow strips can follow the shape of the concrete without problems; and high number of glue joints of installed tiles provides strong glue bond.

These features and benefits will best be understood by reference to the following figures, in combination with the detailed description of the preferred embodiments below.

DETAILED DESCRIPTION OF THE PREFERRED EMBODIMENTS

Figure 1:
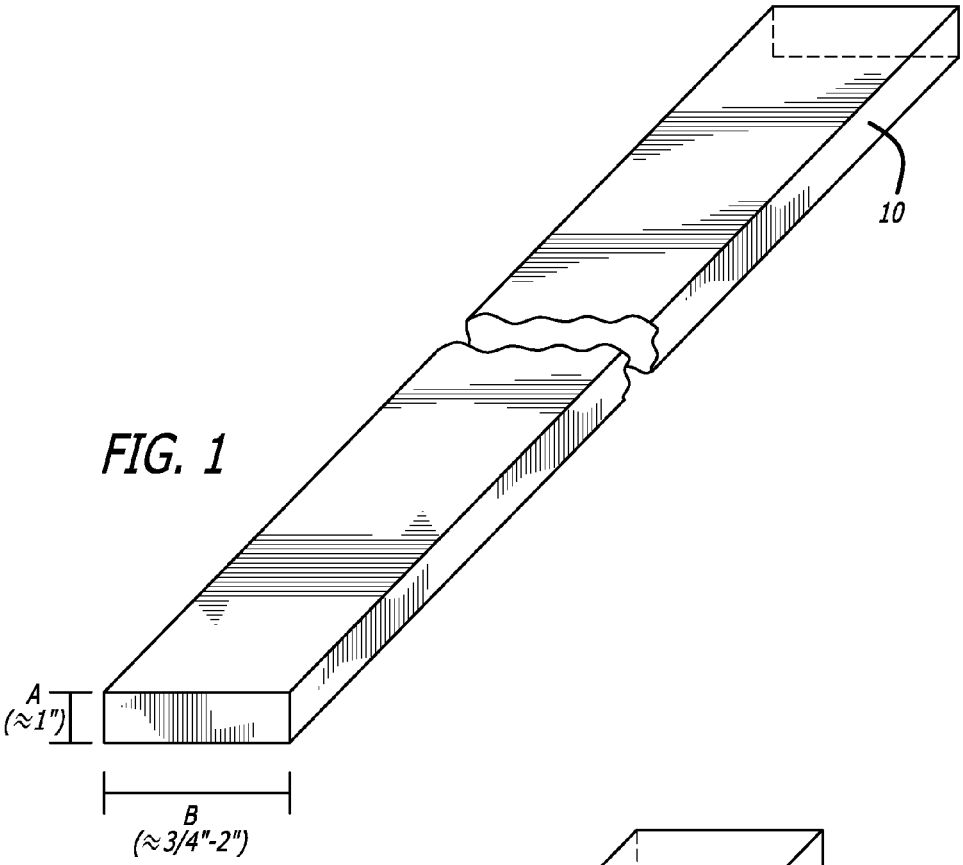
FIG. 1 is an elevated perspective view of a slat of raw wood.
Figure 2:
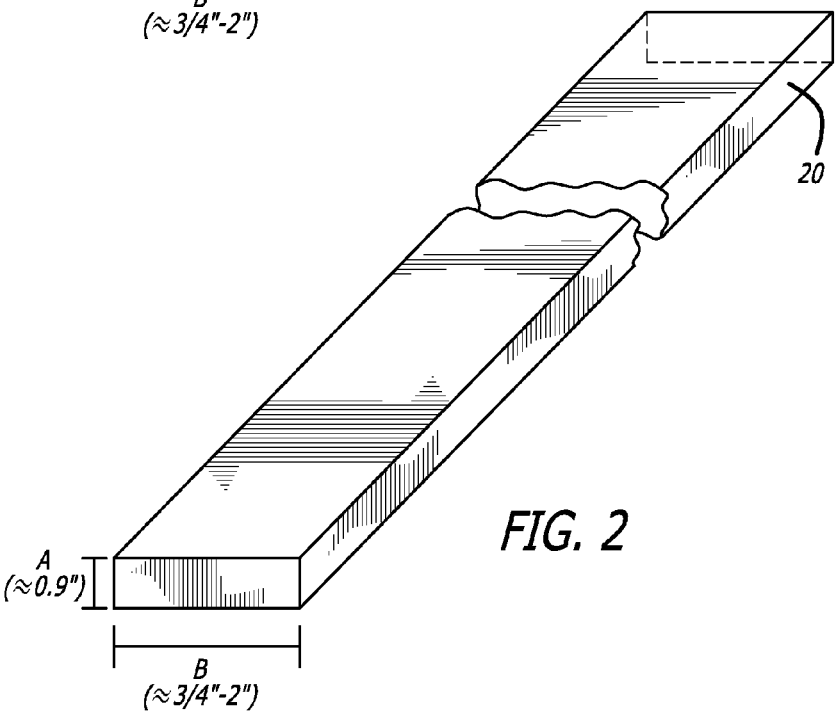
FIG. 2 is an elevated perspective view of a piece of scrap wood after the slat of FIG. 1 is surfaced to a thickness of approximately 0.90 inches.

FIG. 1 illustrates an elongate strip of kiln-dried wood that is the product of a manufacturing process for the manufacture of furniture, flooring, cabinets, doors, windows, or the like. The strip 10 of FIG. 1 is a piece of unused scrap wood that is left after the manufacturing process. The first step in the present invention is to equalize the thickness "A" of the hardwood waste to about $9/10^{th}$s of an inch (FIG. 2). The slat of wood 20 as shown in FIG. 2 has a width "B" of between three fourths of an inch and two inches (¾"-2").

Figure 3:
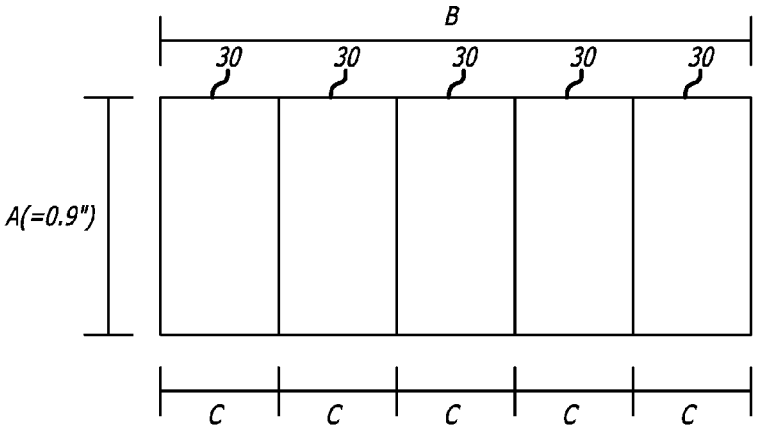
FIG. 3 is a side view of a stack of pieces of scrap wood of FIG. 2 cut to a height of $9/10^{th}$ of an inch.

As a second step, the slats of random widths B are cut into uniform narrow strips 30 having a new width "C" of about $7/16^{th}$s", which will become thickness of the floor (FIG. 3).

Figure 4:
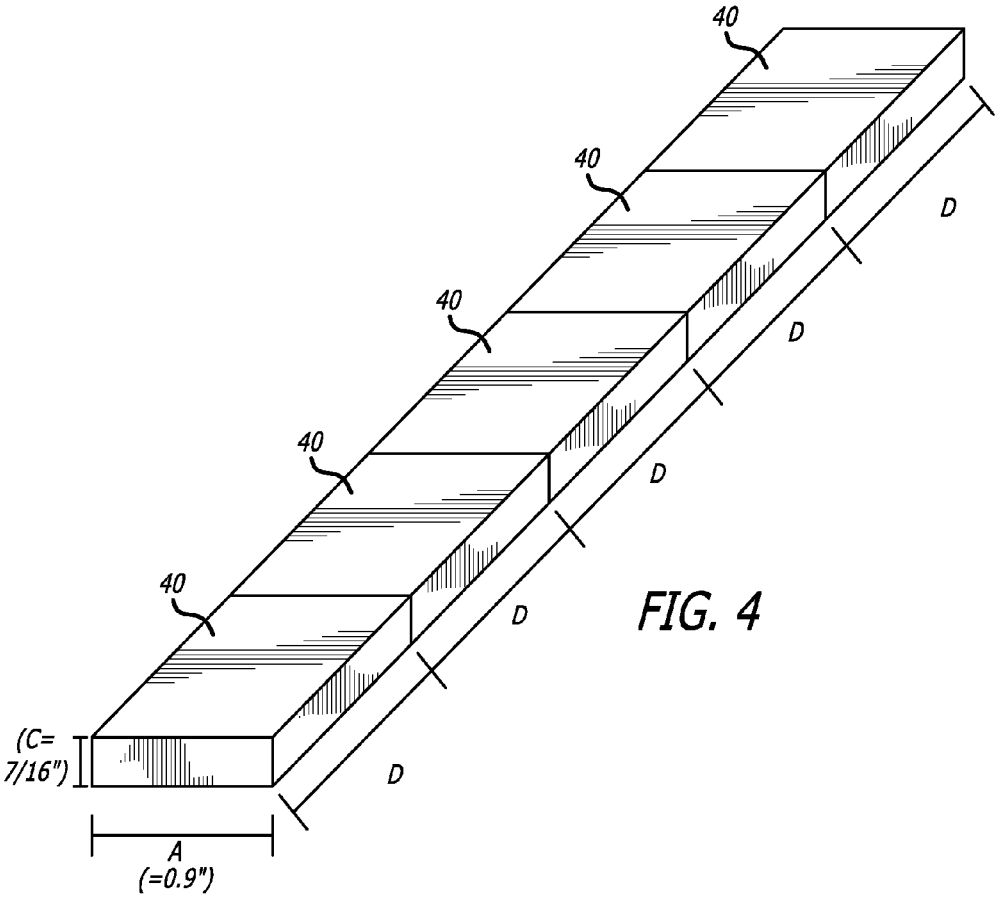
FIG. 4 is an elevated perspective view of a scrap wood of FIG. 2 cut into blocks having a height of $7/16^{th}$ and a width of $9/10^{th}$ and a desired length D.

The elongate, uniform strips 30 having a height of A ($9/10^{th}$s) and width C ($7/16^{th}$s) are then cut into blocks 40 having a desired length "D" as shown in FIG. 4.

Figure 5:
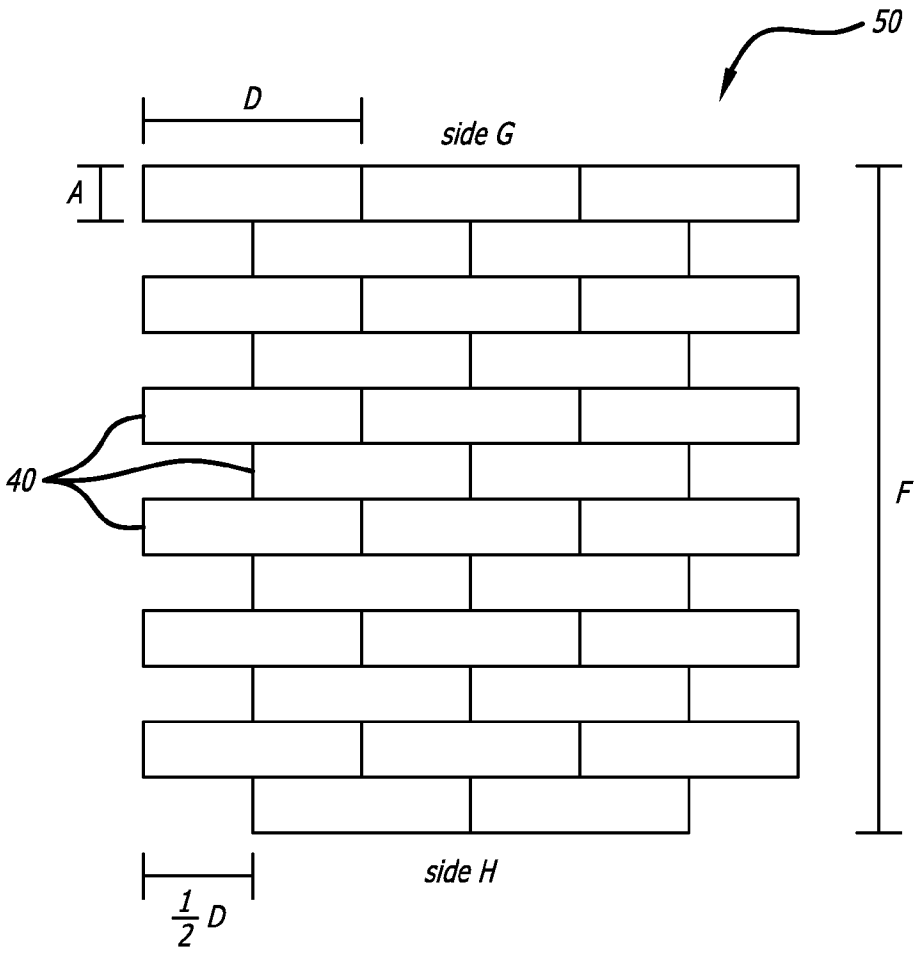
FIG. 5 is top view of a tile made from the blocks of FIG. 4, assembled in a staggered pattern of 3×2×3×2 . . .

The blocks 40 are then assembled into parquet tile 50 having a staggered 3×2×3×2 repeating arrangement having a width "F" (FIG. 5) and an upper side G and lower side H. The blocks 40 are kept together by applying a pressure sensitive adhesive tape over the tile 50.

Figure 6:
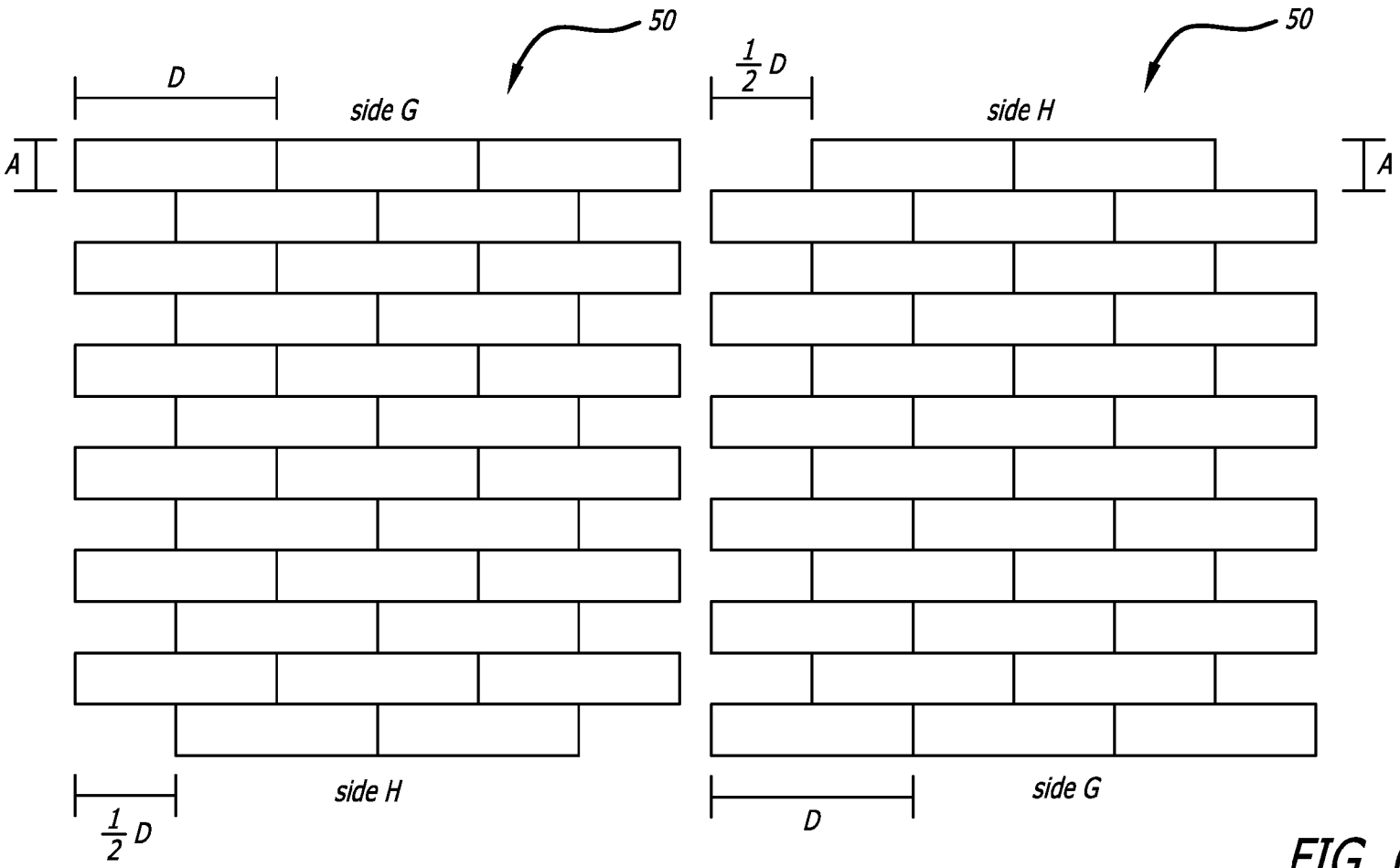
FIG. 6 is a top view of two tiles of FIG. 5, one inverted, showing their complimentary nature.
Figure 7:
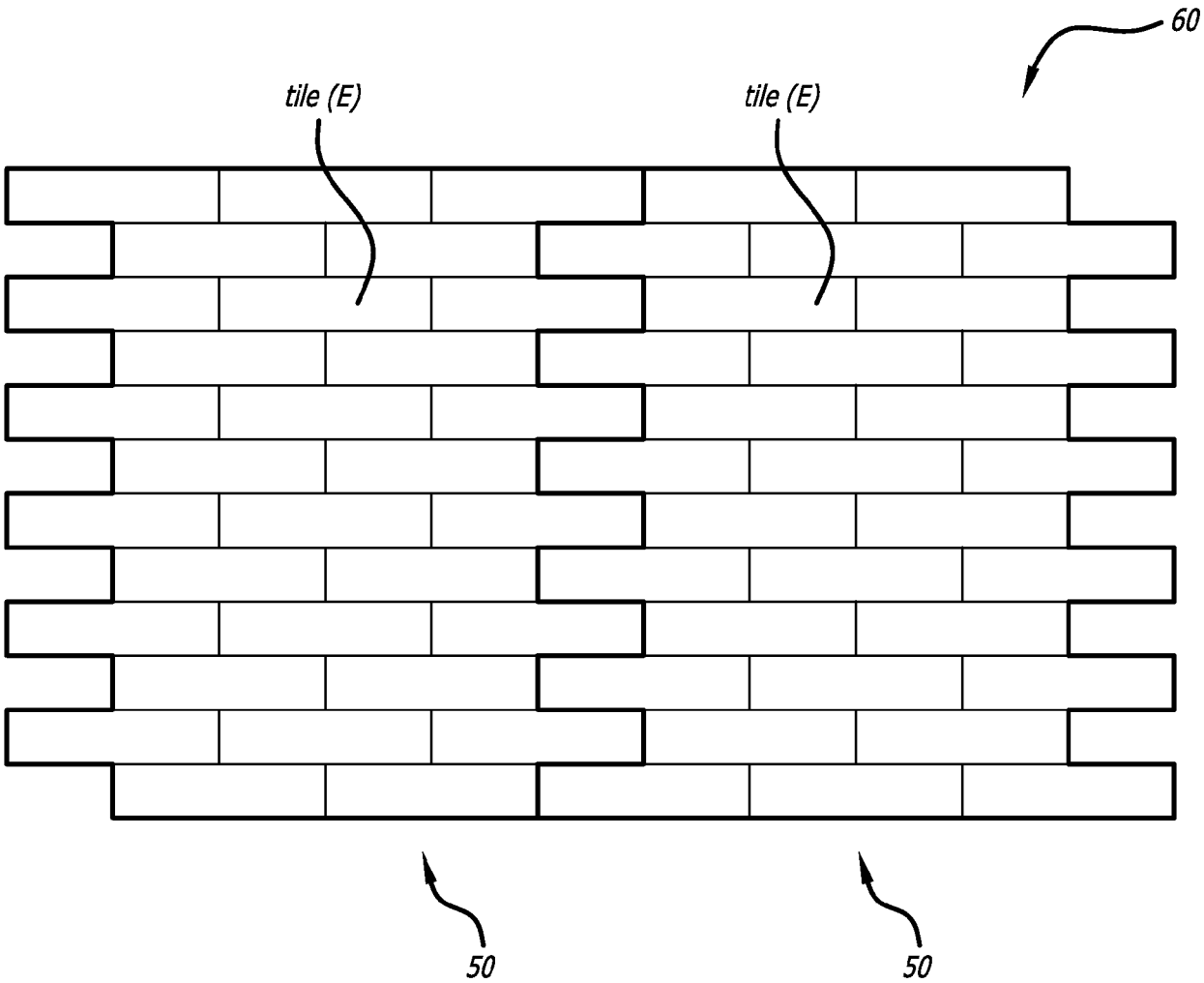
FIG. 7 a flooring made from a plurality of tiles of FIG. 5.

In the next step, the floor 60 is assembled by rotating a first tile 50 (side G on top) one hundred eighty degrees (side G now on bottom) with respect to a second tile (side G on top) as shown in FIG. 6, and then mating the two tiles as shown in FIG. 7, providing the assembled floor 60. Other tiles can be combined in this manner to create a parquet tile flooring made entirely of scrap wood.

The foregoing description of the preferred embodiments are intended to be illustrative only, and not limiting. One of ordinary skill in the art will appreciate many modifications and alterations to the foregoing embodiments, and the present invention is intended to include all such modifications and alternations. Accordingly, the invention's scope is not limited to anything shown in the drawings or in the description, but rather the scope of the invention is governed by the claims below, using their ordinary and customary meanings.

I claim:

1. A method for creating a parquet flooring comprising:

collecting scrap slats of wood from a wood cutting operation having a height "A" of 9/10ths of an inch and a range of widths between three fourths of an inch and two and one half inches (¾"-2½");

cutting the scrap slats of wood into elongate strips having a uniform width of seven sixteenths of an inch (7/16ths");

cutting the elongate strips into blocks having a uniform length "D";

arranging the blocks into tiles having a 3×2×3×2 repeating staggered pattern; and interlocking two tiles together by rotating one of the tiles having the 3×2×3×2 staggered pattern into complimentary pattern having a 2×3×2×3 staggered pattern.

2. The method for creating a parquet flooring of claim 1, wherein a pressure sensitive adhesive tape is used to maintain the blocks in a 3×2×3×2 pattern.

* * * * *